United States Patent [19]

Lim et al.

[11] Patent Number: 4,518,103

[45] Date of Patent: May 21, 1985

[54] METHOD AND APPARATUS FOR RELEASING ADDITIONAL INGREDIENTS IN A PRESSURIZED CONTAINER

[76] Inventors: Walter K. Lim, Aerosol Services Co., 425 S. Ninth St. City of Industry, Calif. 91746;
Arthur A. Krause, 7035 Lanewood Ave., Hollywood, Calif. 90028

[21] Appl. No.: 300,506

[22] Filed: Sep. 9, 1981

[51] Int. Cl.[3] ..... B65D 83/00

[52] U.S. Cl. ..... 222/135; 222/402.1; 222/389

[58] Field of Search ..... 222/399, 394, 145, 1, 222/94, 135, 136, 389, 402.1, 386.5, 129, 251, 402.24, 405, 464

[56] References Cited

U.S. PATENT DOCUMENTS 3,417,901 12/1968 Sands ..... 222/386.5 X
3,578,210 5/1971 Pitrolffy-Szabo ..... 222/52
4,049,158 9/1977 Lo et al. ..... 222/95
4,062,477 12/1977 Morane ..... 222/145
4,340,155 7/1982 Obrist ..... 222/135

*Primary Examiner*—Joseph J. Rolla
*Assistant Examiner*—Michael S. Huppert
*Attorney, Agent, or Firm*—Beehler, Pavitt, Siegemund, Jagger & Martella

[57] ABSTRACT

A method and apparatus are disclosed for delayed release of additional ingredients including additional propellant within a pressurized dispensing container. A reserve container within the primary product container is constructed to open or rupture as a result of a predetermined degree of depressurization of the primary container to release its contents and repressurize the primary container to enable subsequent ejection of product. A catalytic activation system is disclosed as one possible application of this invention.

18 Claims, 7 Drawing Figures

METHOD AND APPARATUS FOR RELEASING ADDITIONAL INGREDIENTS IN A PRESSURIZED CONTAINER

BACKGROUND OF THE INVENTION

1. Field of the Invention

The present invention generally relates to the field of pressurized dispensing containers and is more specifically directed at the improved method and apparatus for releasing additional ingredients into a pressurized dispenser.

2. State of the Prior Art

Applicant is aware of the following patents directed to pressurized dispensing containers:

U.S. Pat. No. 3,235,137 to Bonduris for a pressurized container particularly useful for dispensing shaving cream in which a supply of liquified propellant gas is enclosed by a flexible diaphragm or bag which expands as the supply of shaving foam ingredients is used up to fill the increasing head space. As a result, the remaining ingredients are kept under generally constant pressure within the can to assure even and complete ejection of the same.

U.S. Pat. No. 3,949,911 to Morane for a container pressurizable by heat activation. In this patent the product is initially unpressurized. A supply of propellant in liquified form is sealed in a cartridge located within a flexible pouch within the product container. The container is pressurized by rupturing the cartridge to release the propellant within a gastight pouch which expands within the container to pressurize the same. A preferred method of rupturing the cartridge is by heating the entire container with the product and propellant cartridge within it.

U.S. Pat. No. 2,671,424 to Herring et al. teaches a device for indicating when the contents of a container has been nearly exhausted. A container filled with a fluid under pressure has a capsule containing a colored substance. The capsule is provided with a diaphragm designed to rupture when the internal pressure of the container falls below a level corresponding to near exhaustion of the fluid contents. At that time the colored substance in the capsule is released for admixture with the remaining contents of the container to indicate to a user that the contents are nearly depleted.

U.S. Pat. No. 3,718,236 to Reyner et al. discloses a container wherein a series of bags are ruptured in sequence as the product is used up, each bag releasing additional gas generating substances for repressuring the container. However, the gas is contained within the bags and is not released into the product compartment.

Additionally, applicant has knowledge of the following patents: U.S. Pat. No. 3,178,075 to Riedl et al.; U.S. Pat. No. 3,245,582 to Roth et al.; U.S. Pat. No. 4,062,475 to Harris et al.; U.S. Pat. No. 4,202,470 to Fujii; and U.S. Pat. No. 3,244,331 to Kharasch.

SUMMARY OF THE INVENTION

The present invention contemplates the addition of a secondary or reserve container such as a relatively small vial or a flexible bladder containing a reserve supply of liquefied propellant. The primary container or can is filled with product to be dispensed, a secondary container filled with additional liquefied propellant or a mixture of propellant and chemicals is inserted into the can and the primary container is pressurized by the addition of an initial supply of liquefied propellant and sealed in the conventional manner. The secondary or reserve container is constructed to open or burst to release its contents into the primary chamber of the container when the primary chamber has become depressurized to a predetermined pressure through expulsion of the product ingredients and propellant in the main chamber.

The reserve container may be a relatively small vial of any suitable material such as metal, rubber, glass or plastic, and is provided with a stopper designed to be forced out by the pressure differential between the reserve propellant within the vial and the pressure within the main chamber of the pressurized container. In the alternative, a bladder may be formed of thin film such as polyethylene or laminated polyethylene formed into a tube and heat-sealed at each end to contain the liquefied reserve propellant. The thickness of the film is selected to rupture at a predetermined pressure differential to release the contents of the bladder. Yet, other forms of constructing the reserve container will be described or will become apparent.

It is particularly contemplated that this invention will find application in pressurized dispensers for shaving cream lather wherein the propellant serves the dual function of pressurizing the dispensing container as well as causing foaming of the ingredients upon ejection from the nozzle due to expansion of propellant within the ingredient mixture.

Typically, a can of shaving cream is filled with an emulsion of 95% cream ingredients and 5% propellant. This emulsion typically fills between 85% and 90% of the available volume within the can. As the cream ingredients are expelled they carry with them a portion of the propellant, thus steadily decreasing the quantity of propellant left in the container. Additionally, the head space volume within the can steadily increases as product is ejected therefrom. Propellant in the liquid state in the remaining emulsion gasifies to fill this increasing head space, thus reducing the ratio of propellant to cream in the emulsion. Thus, as the contents of the can are used up the ratio of propellant to cream steadily decreases so that there is less propellant available to foam the cream ingredients upon ejection from the can. As a result the consistency of the lather towards the end of the can tends to become runny and wet. If an attempt is made to correct this condition by increasing the original supply of propellant in the emulsion then there will be an initial excess of propellant such that excessive foaming will occur and the foam at first will be too dry for satisfactory shaving.

While various attempts have been made to dispense lather of uniform consistency throughout the useful life of the container, as exemplified by the Bonduris disclosure, no truly practical or economical solution has been found to date. The secondary supply of propellant contained by the flexible diaphragm of Bonduris is never released into the ingredient emulsion and serves only to expand the membrane into the increasing head space. The Bonduris description states that the diaphragm is not an elastic balloon as suggested by the illustrations but rather a flexible bag, which apparently is initially in a folded-up condition and is then unfolded by gas pressure.

It is possible for the diaphragm as it expands to flatten itself against the can wall, trapping the lower orifice of the filled tube and sealing the orifice to prevent further egress of product from the can.

If the flexible diaphragm is scratched or is otherwise latently defective due to the folds and automatic assembly processes, it may rupture as it unfolds or is stretched, immediately releasing the secondary supply of propellant 26 which is then added to the initial propellant in the emulsion filling the container and resulting in a greatly excessive ratio of propellant to cream. When this emulsion is ejected from the container the excessive propellant therein will cause exaggerated foaming of the cream, rendering the same essentially useless.

The Morane patent contemplates releasing the full supply of propellant upon first use of the container and such release is in fact required to initially pressurize and activate the dispensing container. Once such use has begun no further reserve or ingredient or propellant exists. Additionally, the cartridge containing the liquified propellant can be opened only through some external influence as heat and cannot be obtained by release of pressure within the main chamber of the container since the main chamber is not initially pressurized.

The express teaching of the Morane patent includes the use of an airtight pouch or bag enclosing the propellant released from the ruptured cartridge and thus will not allow the addition of ingredients to the product contained in the main compartment of the dispenser.

In Herring et al. no means are provided for repressurizing the primary container after release of the contents of the capsule.

The present invention further contemplates that ingredients other than the liquified propellant may also be contained within the secondary container for delayed release triggered by depressurization of the primary container chamber. Thus, for example, a catalyst chemical may be enclosed within a reserve bladder together with a supply of reserve propellant in liquified form. A substance is contained in the main chamber which is pressurized with a liquefied propellant and/or carbon dioxide, in addition to air or nitrogen. When it is desired to use the substance the can is inverted and the nozzle is depressed to release air or nitrogen to depressurize the main chamber. When the internal pressure of the container falls below a predetermined level the bladder or other secondary container bursts, releasing both the catalyst and the secondary supply of propellant within the substance in the main chamber. Typically, the secondary propellant within the secondary container will be dissolved or emulsified within the catalyst and will rapidly expand upon release to dispense the catalyst within the substance contained in the primary compartment. The substance is thus activated by the catalyst, thus enabling ejection of the freshly activated substance. It is understood that substances other than catalysts may be contained within the reserve container for delayed release into the primary container.

This method and associated apparatus for releasing additional ingredients within a sealed pressurized dispensing container through depressurization of the container and simultaneously repressurizing the container for subsequent ejection of dispensable product cannot be achieved through any of the devices or systems in the above-cited patents and is novel over the known prior art.

DETAILED DESCRIPTION

Figure 1:
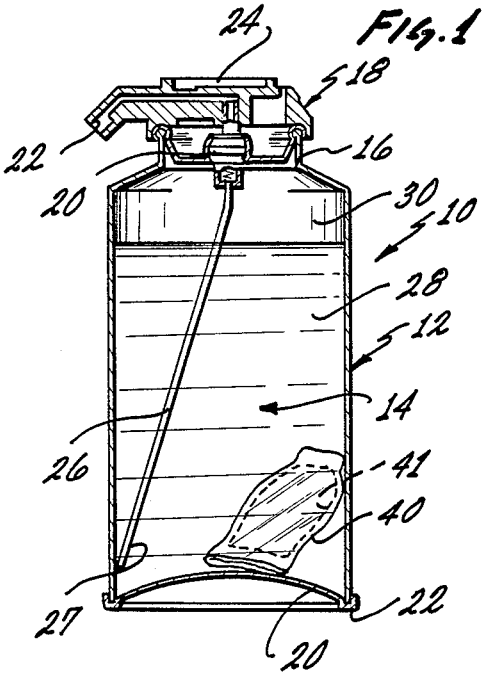
FIG. 1 is an elevational cross-section of a pressurized dispensing container provided with a reserve bladder according to this invention containing a reserve supply of propellant.

With reference to FIG. 1 of the drawings, a typical pressurizable dispensing container is shown in elevational cross section. The container 10 comprises a cylindrical container wall 12 defining a main product compartment or primary container 14. The upper portion of the container comprises inwardly tapering shoulders terminating in a collar 16 to which is secured a valve assembly 18 in a gastight seal capable of containing the pressurized contents of the container. The lower end of the container wall 12 is affixed to a bottom 20 by means of a pressure resistant gastight seal 22.

The valve assembly 18 is of a type presently used in the aerosol can industry and includes a valve 20, a nozzle or outlet opening 22, and a button 24. When the button 24 is depressed the valve 20 opens, bringing the interior 14 of the container into communication with the outlet opening 22 and allowing the expulsion of the product to be dispensed. Typically, the valve assembly 18 is also provided with a dip tube 26 extending from the underside of the valve 16 to nearly the bottom of the product compartment 14.

The compartment 14 is substantially filled with an emulsion consisting of liquified propellant and the product ingredients to be dispensed. In the case of shaving cream the emulsion is typically in the ratio of 95% shaving cream preparation and 5% liquified propellant. The emulsion 28 may fill 85% to 90% of the available volume of the compartment 14 leaving a relatively small head space 30. Initially, this head space is filled with a remnant of air and additionally contains propellant in the gaseous form which pressurizes the head space to a pressure characteristic of the particular propellant used. A number of such propellant substances are in common use such as butane, isobutane, FC-114, FC-12, and are suitable for use in the present invention. Such propellant substances exist in a liquid-gas state of equilibrium wherein a quantity of the liquid propellant passes to the gaseous state to bring the head space to the typical pressure for the particular propellant and the remainder of the propellant remains in the liquid state as an emulsion within the product preparation. As the product is consumed, the head space 30 steadily increases in volume, thus allowing a steadily greater amount of liquid propellant to pass through the gaseous state within the increasing available head space. In this manner, the ratio of liquid propellant in the emulsion decreases as the product is used up. Since the liquid propellant also operates as a foaming agent to cause foaming of the product preparation after expulsion through the nozzle 22, where the liquid propellant is free to expand at atmospheric pressure, the decreasing amount of available foaming agent will cause the product to be dispensed in a more liquid state towards the end of the supply of foam preparation.

The pressure in the head space does not increase beyond the characteristic pressure for the particular propellant substance used so long as an adequate supply of propellant in liquid form is available. However, if ample propellant is supplied within the emulsion to provide adequate pressure to fully expel all of the product within the can, the high ratio of propellant will cause excessive foaming, and a dry foam when product is first expelled from the can until the head space has increased sufficiently to allow the excess propellant to pass to the gaseous form and thus reduce the propellant ratio in the emulsion, thus also reducing the foaming of the product upon expulsion, producing a very liquid product. Thus, absent some pressure-regulating mechanism, the product is ejected at optimum consistency only through a middle range in the consumption process of the product.

Figure 2:
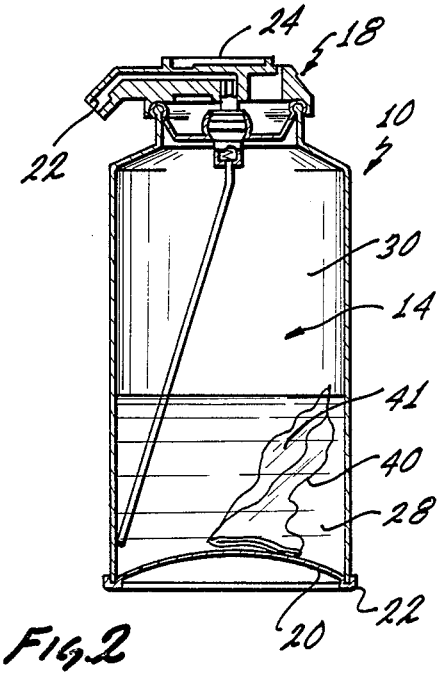
in FIG. 2, the container has been partially depressurized through ejection of some of the product, causing rupture of the bladder and release of the reserve propellant to repressurize the container.

To resolve this difficulty according to this invention, a secondary or reserve container 40 is introduced into the primary cavity 12. In one embodiment the secondary container may be in the form of a bladder 40 best seen in FIGS. 4 and 5, formed of a relatively thin film such as polyethylene or laminated polyethylene. The bladder may be formed by heat sealing the ends of a tubular segment. The secondary container 40 contains a secondary or reserve supply of propellant kept in a liquid state by virtue of being retained under a sufficiently high pressure within the primary container. The primary compartment 14 is also pressurized by an initial supply of propellant introduced with the product preparation 28. Thus, the primary compartment 14 is pressurized to a pressure sufficient to enable expulsion of the product 27 consistent with a propellant-to-product ratio calculated to provide a desirable degree of foaming of the product. As product propellant emulsion is expelled from the container, the decreasing amount of liquid propellant combined with the increasing head space volume result in a gradual decrease in pressure in the main compartment 14. The pressure within the secondary container 40, however, does not drop in proportion since the reserve supply of propellant is sealed therein and the secondary container 40 has a limited degree of elasticity. Thus, the pressure differential between the reserve compartment 41 defined by the secondary container 40 and the primary compartment 14 of the primary container gradually increases as product is expelled. At a certain point, which may be advantageously predetermined, the pressure differential will cause the secondary container to release its contents into the primary compartment 14 where it is free to mix with the remaining product preparation 28. The ratio of liquid propellant to product is thereby increased and freshly available liquid propellant replenishes the head space to raise the pressure in the main compartment 41 to enable continued ejection of the remaining product preparation 28. FIG. 2 of the drawings illustrates the bladder 40 in its ruptured condition, its contents having been released into the primary compartment 14.

The propellant substance in the initial product/propellant emulsion may be the same as the reserve propellant substance. If desired, however, a different propellant substance may be sealed within the secondary container to obtain a higher or lower pressure within the primary compartment 14 after rupture of the secondary container than existed initially within the container. For instance, it may be desirable to repressurize the main compartment 14 to a higher pressure to ensure complete expulsion of the product. This option is not available with the systems of the prior art.

Figure 5:
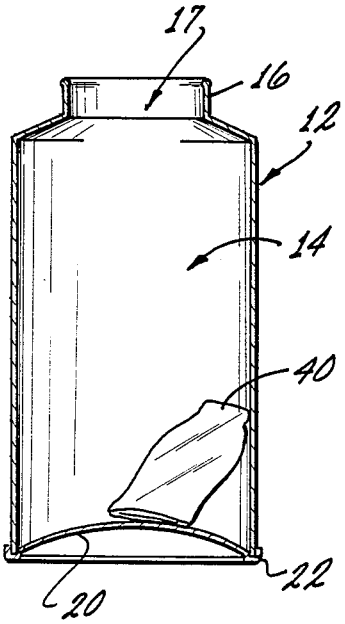
FIG. 5 illustrates the introduction of the bladder into the container prior to closure thereof.

FIG. 5 illustrates one method of introducing the secondary container into the main compartment 14, by simply dropping the bladder 40 through the throat opening 17 defined by the collar 16, prior to attachment of the valve assembly 18. The bladder 40 is previously filled with liquid propellant and is kept in a refrigerated state in order to prevent bursting at atmospheric pressure. After pressurization of the main compartment 14 the reserve supply of propellant in the secondary container is maintained in a liquid state by the pressure of the initial propellant supply in the product compartment 14.

Figure 3:
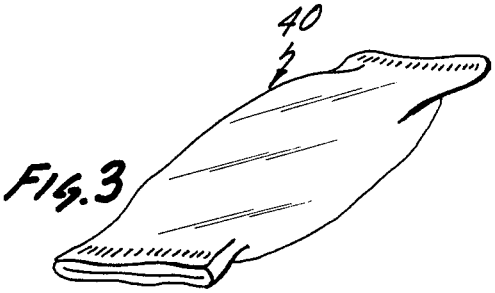
FIG. 3 is a perspective view of one possible form of reserve bladder formed by heat sealing the ends of a tubular segment after filling with liquefied propellant.
Figure 4:
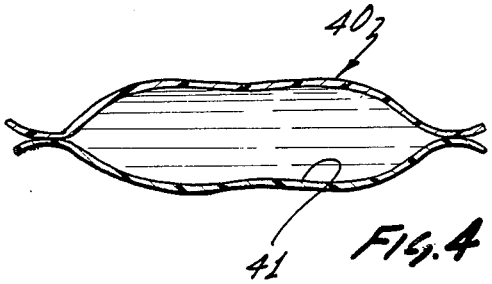
FIG. 4 is a longitudinal cross-section of a reserve bladder filled with liquid propellant according to this invention.

The secondary container may be constructed in a variety of ways. Three possible embodiments are illustrated in the drawings. A presently preferred form for the secondary container shown in FIGS. 3 and 4 is a bladder 40 constructed from a segment of thin wall tubing by heat heat sealing one end, filling the tube with liquid propellant, and heat sealing the opposite end. As has been explained, the bladder is made of a thin film selected to rupture at a predetermined pressure differential. The rupture pressure of the material can be easily determined through simple trial and error for various film thicknesses and materials. The bursting pressure can also be controlled by scoring the film to reduce the normal bursting rupture pressure for a given film thickness.

Figure 6:
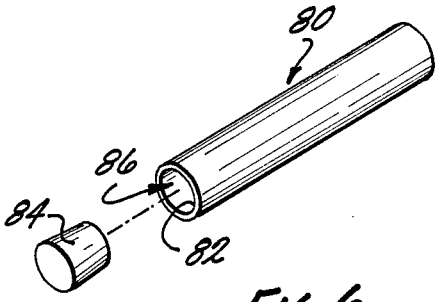
FIG. 6 is an exploded perspective view of an alternate embodiment of the reserve container formed as a stoppered vial.

An alternate embodiment for the secondary container is illustrated in FIG. 6 wherein a vial 80 of tubular form is closed at an open end 82 by means of a stopper 84 forced into the open end 82 to make a friction fit. The stopper 84 may be dimensioned and inserted into the opening 82 so that the stopper will be forced out of the opening and ejected by a predetermined pressure differential between the pressure in the reserve compartment 86 inside the vial 80 and the external pressure acting upon the stopper 84. It will be apparent that both the bladder 40 and the vial 80 may take forms other than those shown in the drawings, and the invention is by no means limited to the specific embodiments described.

Figure 7:
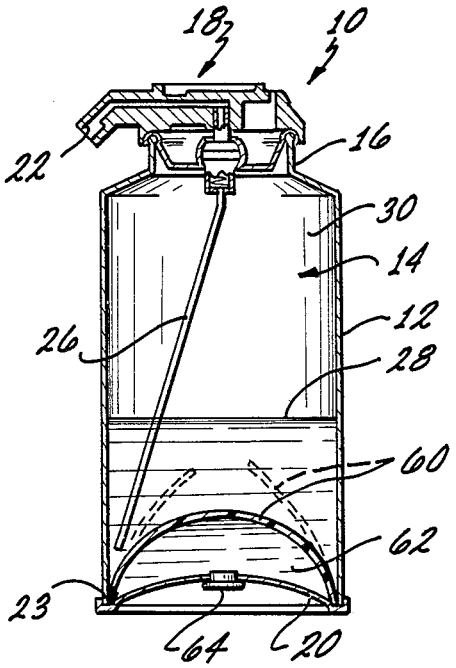
FIG. 7 is yet another embodiment of the invention wherein the reserve compartment is formed by a membrane secured to the bottom of a dispensing container, the membrane also being shown in dotted lines after rupture and release of the reserve propellant.

A third embodiment of the invention is illustrated in FIG. 7 wherein the reserve container is formed by a membrane 60 which defines a reserve compartment 62 with the bottom 20 of the container 10. A self-sealing plug 64 is inserted through an opening in the bottom 20 to permit filling of the reserve compartment, as by injection with a hollow needle. The membrane 60 is preferably affixed in a pressure-tight seal at the lower rim 23 of the container wall 12 and held thereto by the rim of the bottom 20 which is rolled onto the edge of the cylindrical walls 12. The membrane may be of a partially elastic or substantially inelastic material, but in either case is constructed to rupture as shown in dotted lines in FIG. 7 when a desired pressure differential is reached between the reserve compartment 62 and the primary compartment 14, thereby releasing the contents of the reserve compartment.

The time of release of the reserve propellant supply may be timed to occur at any desired point in the product ejection process by selecting the proper rupture pressure differential of the secondary container. Of course, if a propellant substance is used as a reserve supply having a lower characteristic pressure than the propellant substance in the main compartment it will be necessary to further deplete the supply of the primary propellant in order to bring about a sufficient pressure differential to rupture the bag. Conversely, if a higher characteristic pressure is selected for the reserve propellant supply a given pressure differential between the reserve supply and the initial supply of propellant will be more readily achieved and a more resistant secondary container may be desirable if late release of the reserve supply is desired. Thus, there is a degree of interplay between the selected reserve propellant substance and the rupture resistance of the secondary container.

A further application of the present invention involves the addition of a substance such as a catalyst into the secondary container for release and admixture with a product composition in the primary compartment 14 at a selected time. Thus, for example, if the main compartment 14 is filled with an adhesive activatable by a suitable catalyst, the catalyst must be released just prior to use to prevent the adhesive from hardening within the dispensing container.

This objective can be realized by storing the catalyst in the secondary container along with a reserve supply of propellant. The primary container is filled with product and pressurized with a liquefied propellant on a soluble compressed gas such as carbon dioxide or nitrous oxide. The primary container is then overpressurized with a nonsoluble compressed gas such as air or nitrogen. The soluble compressed gas pressurizes the product compartment to e.g. 55 p.s.i., a sufficient pressure to fully eject the product. The nonsoluble gas is added to raise the pressure of the primary compartment to e.g. 70–80 p.s.i. The main compartment is initially overpressurized with air, nitrogen, or any other suitable means.

The reserve supply of propellant is calculated to rupture the secondary container when the primary container is depressurized to e.g. approximately 55 p.s.i. The container thus filled may be stored in this condition until it is desired to use the product. At that time, and just prior to use, the dispensing container is inverted such that the lower end 27 of the dip tube 26 extends upwardly into the head space. The button 24 is then pressed to open the valve 20, allowing release of the gas in the head space to depressurize the main compartment 14. The nonsoluble gas is released first from the head space and the soluble propellant gas will only then begin to gassify, having been kept in a liquid state until then. When predetermined critical pressure level is reached, the reserve supply of propellant within the secondary container 40 ruptures or opens the secondary container dispersing the catalyst within the adhesive or other product in the main compartment. To some extent, the reserve supply of propellant also serves to repressurize the main compartment to a pressure level sufficient to fully eject the activated product after the can has been returned to its normal upright position, although the initial supply of soluble propellant in the primary compartment may suffice for this purpose.

It is contemplated that the scope of the invention extends to any system or method adapted to release an additional quantity of ingredients within a dispensing container by opening a secondary container as a result of depressurization of the main dispensing container. For purposes of this disclosure and the following claims, the term "ingredients" is defined to include propellant substances.

While the method and apparatus of this invention have been described in connection with a dispensing container for a lathering product and a catalyst release system, the invention is not limited to these particular applications and numerous other uses exist for the presently disclosed invention. Applicant therefore intends to be bound only by the scope of the following claims.

What is claimed is:

1. A dispensing container comprising:

a primary container pressurized by an initial supply of propellant including a first liquified propellant and a gaseous propellant and containing a first substance to be expelled therefrom under pressure;

valve means communicating only with said primary container for dispensing the contents of said primary container; and a secondary container within said primary container closed against said gaseous propellant and pressurized by a reserve supply of liquified propellant having a characteristic head pressure higher than said first liquified propellant, and containing a second substance to be added to said first substance, said secondary container being constructed to open and release said second substance into said primary container only upon establishment of a predetermined pressure differential between the interior of said primary container and the interior of said secondary container by discharge of said gaseous propellant from said primary container through said valve means.

2. The apparatus of claim 1 wherein said secondary container is a tube of relatively thin material sealed at its two ends, said thin material being selected to rupture at a desired differential between the interior pressure in said secondary container and the pressure within said primary container.

3. The apparatus of claim 1 wherein said secondary container is a vial closed by means of a stopper, said stopper being adapted to be ejected from said vial at a predetermined pressure differential between the interior of said vial and the interior of said primary container.

4. The apparatus of claim 1 wherein one of said first and second substances is a catalyst for activating the other of said substances prior to use.

5. The dispensing container of claim 1 wherein said secondary container is a tube having a closed end and an open end and provided with a stopper adapted to fit into said open end in friction fit engagement with said tube.

6. The dispensing container of claim 1 wherein said secondary container is loosely contained within said primary container.

7. The dispensing container of claim 1 wherein said reserve propellant is soluble in said second substance thereby to expel and disperse said second substance into said primary container upon its release.

8. The dispensing container of claim 1 wherein said reserve propellant is emulsifiable with said second substance thereby to expel said second substance when said secondary container is opened.

9. A method for separately storing ingredients in a pressurized dispensing container such that the ingredients may be admixed by partial depressurization of the container just prior to use, said method comprising the steps of:

introducing a first ingredient in a primary container and a second ingredient in a detached sealable secondary container, said secondary container being constructed to open and release its contents only at a predetermined pressure differential between its internal pressure and the pressure in said primary container;

introducing a reserve supply of liquified propellant into said detached secondary container;

closing said secondary container to seal said second ingredient and said reserve liquified propellant therein and to seal said secondary container against an overpressurizing propellant in said primary container;

introducing said secondary container into said primary container; and pressurizing said primary container with a first liquified propellant and a second gaseous propellant, said first propellant having a characteristic head space pressure sufficiently lower than said reserve propellant to cause said secondary container to open within said primary container, said second propellant overpressurizing only the primary container to prevent such opening of the secondary container until the second propellant is released from the primary container.

10. The method of claim 9 wherein said first propellant is soluble in said first ingredient and said second propellant is insoluble in said first ingredient.

11. The method of claim 9 further comprising the step of partially depressurizing said primary container to cause said secondary container to open and discharge the second ingredient into the primary container.

12. The method of claim 9 wherein said second propellant is selected from the group comprised of air and nitrogen.

13. The method of claim 9 wherein said first propellant suffices to fully eject said ingredients from said primary container.

14. The method of claim 9 further comprising the step of refrigerating said secondary container prior to its introduction into said primary container to thereby maintain said reserve propellant in a liquid state pending pressurization of the primary container.

15. The method of claim 9 wherein said reserve propellant is soluble or emulsifiable with said second ingredient such that the reserve propellant also expels the second ingredient upon opening of the secondary container.

16. A method for filling a pressurized dispensing container comprising the steps of:

providing a primary container including an open end and a valve assembly attachable to said primary container for sealing said open end;

providing a sealable secondary container dimensioned to fit into said primary container through said open end, said secondary container being constructed to open only at a predetermined differential between its internal and external pressure so as to release its contents including liquids into said primary container;

introducing a liquified propellant into said secondary container;

refrigerating said secondary container to a sufficiently low temperature to keep said propellant in a liquid state at atmospheric pressure;

introducing a second substance into said secondary container;

closing said secondary container such that its contents are sealed therein and said secondary container is sealed against an overpressurizing gaseous propellant in said primary container;

introducing said secondary container into said primary container;

attaching said valve assembly to seal said primary container;

filling said primary container with a product to be dispensed therefrom under pressure; and pressurizing said primary container with a first liquified propellant and a second gaseous propellant, said liquified propellant having a characteristic head space pressure sufficiently lower than said reserve propellant to cause said secondary container to open within said primary container, said gaseous propellant overpressurizing only said primary container to prevent opening of said secondary container until said primary container is partially depressurized by releasing said second propellant.

17. The method of claim 16 wherein the first propellant is a liquified propellant soluble in the product filling the primary container, and the second propellant is a gaseous propellant insoluble in said product.

18. The method of claim 16 wherein said first propellant suffices to fully eject said product from said primary container.

* * * * *